United States Patent [19]

Chadbourne, Sr. et al.

[11] Patent Number: 4,552,166

[45] Date of Patent: Nov. 12, 1985

[54] SECONDARY CONTAINMENT SYSTEM AND METHOD

[75] Inventors: Daniel I. Chadbourne, Sr.; Daniel I. Chadbourne, Jr., both of San Mateo, Calif.

[73] Assignee: DC Technologies, Inc., Oakland, Calif.

[21] Appl. No.: 597,614

[22] Filed: Apr. 6, 1984

[51] Int. Cl.[4] ..... F16K 43/00

[52] U.S. Cl. ..... 137/15; 137/312; 137/315; 137/386; 137/429; 137/587; 138/93; 138/104; 220/426; 220/461; 220/465

[58] Field of Search ..... 137/15, 312, 315, 429, 137/386, 584, 587; 138/93, 104; 220/426, 460, 461, 465, 468

[56] References Cited

U.S. PATENT DOCUMENTS

| | | | |
|---|---|---|---|
| 3,068,561 | 12/1962 | Jones | 220/465 |
| 3,158,383 | 11/1964 | Anderson et al. | 220/460 |
| 3,477,610 | 11/1969 | Hansen | 220/461 |
| 3,780,900 | 12/1973 | Yamamoto | 220/9 LG |
| 4,239,416 | 12/1980 | Borca et al. | 220/461 |
| 4,376,489 | 3/1983 | Clemens | 220/1.5 |
| 4,408,628 | 10/1983 | Monk | 137/312 |

FOREIGN PATENT DOCUMENTS

| | | | |
|---|---|---|---|
| 1210381 | 2/1966 | Fed. Rep. of Germany | 220/461 |
| 0617147 | 5/1980 | Switzerland | 220/461 |

*Primary Examiner*—G. L. Walton

*Attorney, Agent, or Firm*—Townsend & Townsend

[57] ABSTRACT

A storage system with 100% secondary containment includes a rigid outer vessel, a flexible cell inner vessel and a spacer layer therebetween. The region between the outer and inner vessels is monitored for leakage through either the rigid outer vessel or the flexible inner vessel. A number of expandable positioning rings keep the inner vessel substantially inflated regardless of the amount of fluid within the inner vessel. Outlet openings are formed in the outer and inner vessels to permit the passage of fluid into and out of the inner vessel. To retrofit a rigid vessel in use, the vessel is emptied, a manhole opening is cut, the vessel is inspected and conditioned as necessary, and the inside surface is covered with a coating layer. A spacer layer is mounted to the coating layer to cover the inside surface of the outer vessel. Fluid detectors and a suction tube are mounted within channels formed in the spacer layer. The flexible inner vessel is placed into position within the rigid vessel and is inflated. Openings in the inner and outer vessels are secured to one another. Expandable positioning rings are mounted within the inner vessel to keep it in an inflated condition to reduce stress on the inner vessel during use.

18 Claims, 7 Drawing Figures

SECONDARY CONTAINMENT SYSTEM AND METHOD

BACKGROUND OF THE INVENTION

The contamination of the earth, including the soil and groundwater, by toxic chemicals from leaky storage vessels is now recognized as a serious problem. The only accepted solution to eliminate ground pollution from leaky storage vessels is to provide 100% primary containment and 100% of secondary containment. Many new tanks are provided with secondary containment by using a double-walled tank with a space between the inner and outer vessels. By monitoring the space between the inner (primary containment) and outer (secondary containment) vessels, a leak in the inner vessel (which destroys secondary containment) can be detected to allow the inner vessel to be drained.

U.S. Pat. No. 4,408,628 to Monk shows a method intended to repair leaky storage tanks. This patent provides a solution based on the premise that the in-place repair of leaky tanks with glass fiber resins or the like has not been accepted for hazardous materials. Monk proposes the use of an inflatable bladder to be placed in the tank. The tank would have a large manhole-like main access opening cut in its top with the various tank openings, such as fill, pump and vapor recovery for gasoline storage tanks, relocated to the main access opening. The bladder has a single opening connected to the access opening and fills up and collapses according to the fluid level within the bladder. The space between the bladder and existing tank is monitored to determine if anything leaks. Although Monk may provide a solution to leaky tanks in certain circumstances, it does not repair the tank, nor does it provide true 100% secondary containment system as is being mandated by law for new hazardous material storage vessels. Further, the entire bladder hangs from the access opening when the bladder is empty. This puts a great stress on the bladder fabric which can lead to early failure.

SUMMARY OF THE INVENTION

The present invention is directed to a storage tank with secondary containment and includes a rigid outer vessel, a spacer layer having a number of channels formed therein and mounted adjacent the inside surface of the outer vessel, and a flexible cell inner vessel mounted internal of the spacer layer and sized to generally conform to the shape of the spacer layer inner surface. A number of positioning members keep the inner vessel in a substantially inflated condition.

A number of outlet openings are formed in the outer and inner vessels to permit the passage of fluid into and out of the inner vessel. The region between the outer and inner vessels is monitored for leakage through either the rigid outer vessel or through the flexible inner vessel, typically at a low point within the storage tank.

When used to retrofit a rigid vessel in use, the rigid vessel is first emptied of its contents and then a manhole opening is formed in the vessel. The vessel is cleaned, inspected and repaired as necessary. The inside surface of the rigid vessel is then covered with a relatively thick, rigid coating. The spacer layer is applied in the form of a number of spacer segments, preferably having interlocked edges, until the inside surface of the outer vessel is covered with the spacer segments. Fluid detectors, suction tubes and other types of monitors are mounted at appropriate places, typically within the channels formed in the spacers. The flexible cell inner vessel is placed within the rigid vessel and inflated.

The flexible vessel has a number of openings corresponding to openings in the rigid vessel. The openings in the inner vessel are temporarily sealed and are guided toward the corresponding openings in the outer, rigid vessel during inflation of the flexible inner vessel. After inflation, the positioning members are mounted within the flexible inner vessel so that the inner vessel maintains its substantially inflated condition regardless of the liquid level or the gas or vapor pressure within the inner vessel.

A primary advantage of the present invention is that it is suitable for both existing, in place tanks and new tanks; in both cases the present invention can provide a secondary containment tank at reasonable cost. When used with a new tank, the resulting secondary containment tank can be lighter and less expensive than a conventional double-walled tank using two rigid vessels, one within the other. When used with existing, in place tanks, it provides true 100% secondary containment at a cost much less than the cost for removal and replacement with a new tank. The existing tank is preferably coated with a relatively thick coating (for example 0.125 inch thick) during the conversion process. This eliminates erroneous readings which could result from chemicals, such as hydrocarbons, previously absorbed into the walls of the rigid vessel passing back into the region between the outer and inner vessels.

Another advantage of the present invention is that all standard outlets, for example, fill, vent, vapor recovery and pump openings found on many gasoline storage tanks, need not be moved or modified. This is very important since in many circumstances the location of these outlets are strategically placed so that modifying their position is not desirable and often would be very costly.

The present invention uses positioning members, typically expandable rings mounted within the inner vessel, so that the inner vessel remains in a generally inflated condition regardless of the amount of fluid within the inner vessel. This is very important since the repeated flexing of the inner vessel during use, due to the inner vessel being filled and emptied, would otherwise tend to place great strain on the inner vessel where it is connected to the manhole and various outlets. Therefore the positioning members reduce the flexing of the inner vessel during use and also eliminates the strain on the flexible inner vessel which would otherwise exist where the inner vessel is connected to the outlets and manhole. Thus premature failure at those connection points is substantially eliminated.

Other features and advantages of the present invention will appear from the following description in which the preferred embodiment has been set forth in detail in conjunction with the accompanying drawings.

DETAILED DESCRIPTION OF THE PREFERRED EMBODIMENT

Figure 1:
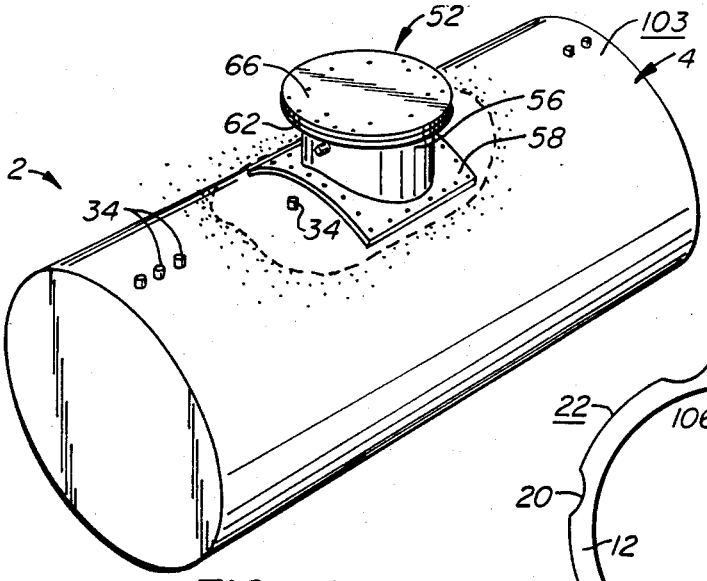
FIG. 1 is an isometric view of an in-ground tank modified according to the invention.

The present invention is described below in terms of its use with an existing, in-ground storage vessel. This is considered to be a primary use of the invention; however, the invention can also be used with above-ground storage vessels or be used to create new secondary containment systems as well.

Turning now to FIGS. 1–4 a secondary containment system 2 is shown. System 2 includes a used rigid outer vessel 4, formerly used to store gasoline and shown to have the earth about a portion of its upper region removed for its retrofit. A flexible cell inner vessel 6 is housed within outer vessel 4 and is supported in its inflated condition by a number of resiliently expandable positioning rings 8. Inner vessel 6 is made from a urethane-nylon-urethane layered fabric designed to hold gasoline. A separation layer 10 separates outer and inner vessels 4, 6 from one another.

Layer 10 is made up of a number of arcuate separator panels 12, positioned adjacent a coating layer 15 (FIG. 4) covering the arcuate inside surface 14 of outer vessel 4. Planar separator panels 16 are mounted against coating layer 15 covering the inside surface 14 of outer vessel 4 at its ends 18.

Panels 12, 16 have fluid collection grooves 20 formed in their outer surfaces 22. These grooves 20 allow liquid which enters the region 24 between outer and inner vessels 4, 6 to collect at a low point 26 within outer vessel 4. A fluid detector 28, adapted to sense the presence of, typically, gasoline and water, is mounted at low point 26. Conduits 30 connect detector 28 with appropriate sensing, monitoring and suction equipment 31 external of system 2. Conduit 30 passes along grooves 20 within panels 12, 16. A suction tube 32 is also directed along grooves 20 and is used to remove accumulated moisture which collects at low point 26 of region 24.

Figure 3A:
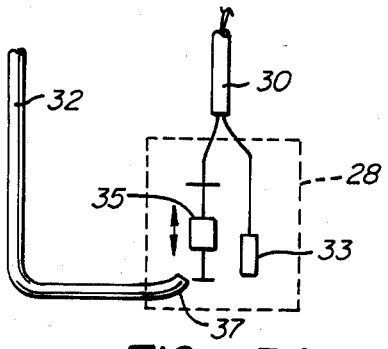
FIG. 3A is a simplified representation of the fluid detector.

Detector 28, shown in FIG. 3A, includes a water detector 33 and a float 35 to sense the level of any liquid which may collect at low point 26. Equipment 31 is constructed so if water detector 33 is not actuated but float 35 is, then a gasoline leak is presumed. Although direct sensing gasoline sensors are available, they are much more expensive than this approach. To check if float 35 is operational, the lower end 37 of suction tube 32 is positioned generally beneath float 35. Upon blowing air back into tube 32, float 35 will be forced upwardly when float 35 is operating properly. If equipment 31 does not sense such movement, then float 35 is likely jammed.

Figure 5:
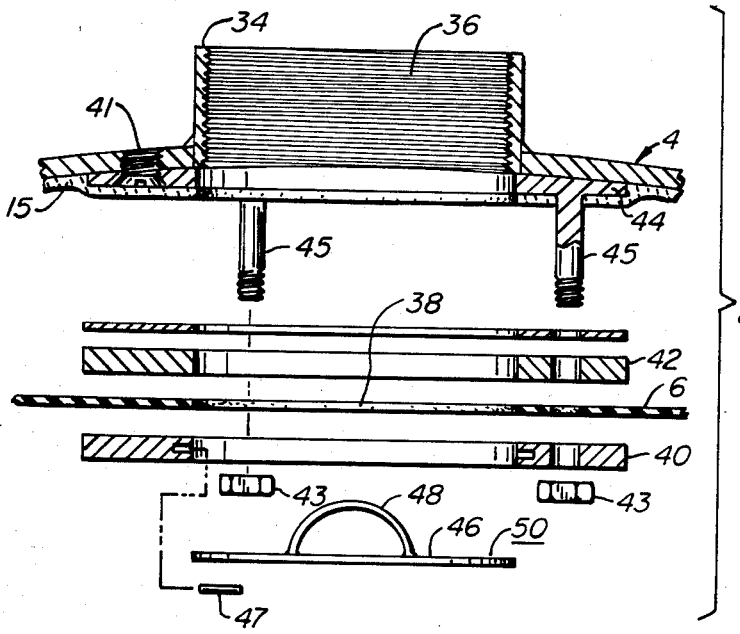
FIG. 5 is an exploded cross-sectional view of an outlet opening.

Referring now to FIGS. 1 and 5, several standard pipe connections 34 are shown providing outlet openings 36 in outer vessel 4. For gasoline storage tanks connections 34 are typically provided for filling and venting system 2, pumping gasoline from system 2, pumping gasoline from one system to another and recovering vapors. Corresponding openings 38 in inner vessel 6 underlie openings 36. Openings 38 in inner vessel 6 are each bounded by a pair of sealing rings 40, 42 which are used to mount inner vessel 6 at openings 38 to outer vessel 4 at openings 36 against adapters 44. Adapters 44 are secured to vessel from the inside of vessel 4 by several screws 41. Adapters 44 have several depending studs 45 over which rings 40, 42 are secured by nuts 43. Portions of panels 12 underlying openings 36 are cut away to allow this mounting. A plug 46 is mounted within ring 40 by a pair of pins 47 to seal opening 38 during inflation of inner vessel 6 as described below. A rope ring 48 is mounted to the upper surface 50 of plug 46. A rope or line, not shown, is connected to ring 48 during inflation of inner vessel 6 to help guide openings 38 towards openings 36, also described below.

To monitor the amount of gasoline in inner vessel 6, a dip stick is usually inserted through the outlet opening 36 used to fill system 2 with gasoline. The fill opening typically has a conventional drop tube 49 (FIG. 3) extending almost to the bottom of vessel 4. A plate 51, mounted to positioning ring 8 directly beneath the drop tube 49, is used to protect inner vessel 6 from the rush of gasoline entering vessel 6 and against the impact of the dip stick.

Figure 6:
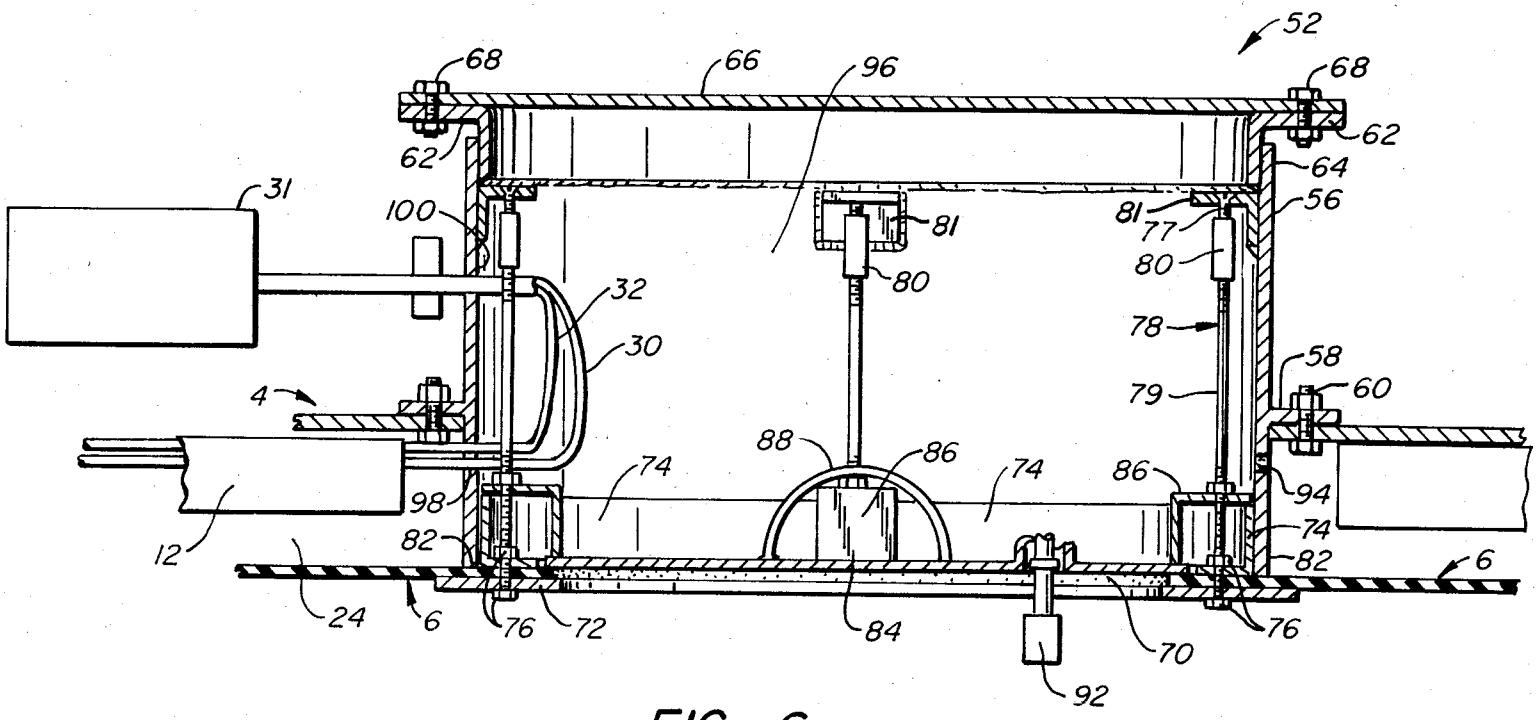
FIG. 6 is a detailed cross-sectional view of the manhole assembly.

Turning to FIG. 6, manhole assembly 52 will be described. Manhole assembly 52 is mounted to a manhole opening 54 formed in outer vessel 4 during the retrofit of the outer vessel. Assembly 52 includes a cylindrical manhole structure 56 sized to fit within opening 54 and secured to outer vessel 4 by a curved mounting skirt 58 using nuts and bolts 60. An upper rolled mounting ring 62 is mounted to the upper end 64 of structure 56 and is used to support an outer manhole cover 66. Cover 66 is removably secured to ring 64 by nuts and bolts 68.

Inner vessel 6 includes a manhole opening 70 surrounded by a lower clamping ring 72 and an upper clamp facing sleeve 74. Ring 72 and sleeve 74 are biased towards one another by nuts 76 mounted on adjustable length rods 78. Rods 78 include upper portions 77 and lower portions 79 connected by adjustable couplings 80. Rods 78 are suspended from L-shaped brackets 81, which are welded to the inside surface of structure 56, by upper segments 77. Adjustable couplings 80 allow lower ring 72 to be forced towards the lower circular edge 82 of structure 56 to clamp ring 72 in place.

An inner cover 84 is used to seal manhole opening 70. Cover 84 is supported by lower clamping ring 72 and is secured in place by a number of L-shaped clamping members 86 which force the peripheral edge of cover 84 against inner vessel 6 and lower clamping ring 72. Inner cover 84 includes a handle 88 and a liquid level switch 92, which is used to keep from over filling inner vessel 6.

Manhole structure 56 includes a number of lateral openings 94 to equalize the pressure between the interior 96 of manhole assembly 52 and region 24 between outer and inner vessels 4, 6. A vent outlet 97 allows region 24 and interior 96 to be vented to atmosphere. Structure 56 also includes appropriate passageways 98 to permit conduit 30 and suction tube 32 to pass from region 24 into interior 96. Conduit 30 and tube 32 then pass through a passageway 100 in structure 56 where they terminate at appropriate sensing, monitoring and suction equipment 31.

The present invention has been described above with reference to a vessel 4 which has been modified or retrofitted to arrive at secondary containment system 2. However, the present invention can also be incorporated into new secondary containment systems. When the above-described structure is used with new secondary containment systems, such items as coating layer 15 may not be needed. Also, inner vessel 6 has been shown to be held in its inflated condition by positioning rings 8 mounted within vessel 6. Other types of positioning members used to keep vessel 6 in a substantially inflated condition may be used as well. Although manhole assembly 52 may not always be necessary with newly constructed secondary containment systems, it is generally advantageous to use one to allow convenient access if replacement or repair is necessary.

Having described the structure of secondary containment system 2, a preferred method of retrofitting outer vessel 4 to arrive at system 2 will now be described.

The earth around vessel 4 is partially excavated to expose the upper surface 103 of vessel 4. Vessel 4 is then emptied of its contents. Vessel 4 is isolated from other gasoline storage tanks, pumps and so forth as needed. Vessel 4, used to hold gasoline, must be very thoroughly cleaned so that flammable vapors do not concentrate to a hazardous point. Prior to cutting opening 54 in vessel 4, the vessel is thoroughly purged with air to remove all residue capable of producing flammable vapors. The vapor concentrations in the purging air leaving vessel 4 are monitored to insure that cutting operations do not begin before it is safe.

Opening 54 is then cut in vessel 4. While pumping fresh air into vessel 4, the interior is cleaned, removing any scale which may be within vessel 4. Inside surface 14 of vessel 4 is inspected for any cracks or damage. Inside surface 14 is then sandblasted or otherwise cleaned and cracks or other defects are patched. Manhole assembly 52 and adaptors 44 are mounted to vessel 4 adjacent openings 36 and 54. The entire inside surface 14 is then primed and coated with a material compatible with that to be held within inner vessel 6, in this case gasoline, to create coating layer 15. The patching and sealing for steel storage tanks is preferably accomplished in accordance with Uniform Fire Code Standard No. 79-6, or that currently in force.

It is important that coating layer 15 be applied all over inside surface 14. In the event of a leak of inner vessel 6, layer 15 acts to prohibit the contamination of the surrounding earth so true secondary containment of the fluid within inner vessel 6 is achieved. Layer 15 also helps to prevent hydrocarbon residue build-up from the previously used outer vessel 4 within region 24 to reduce the possibility of a false indication of a leak in inner vessel 6.

Figure 2:
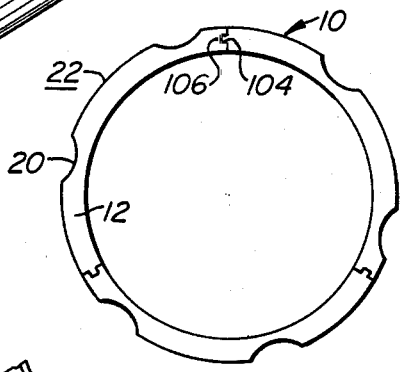
FIG. 2 illustrates the arrangement of the arcuate separator panels.
Figure 3:
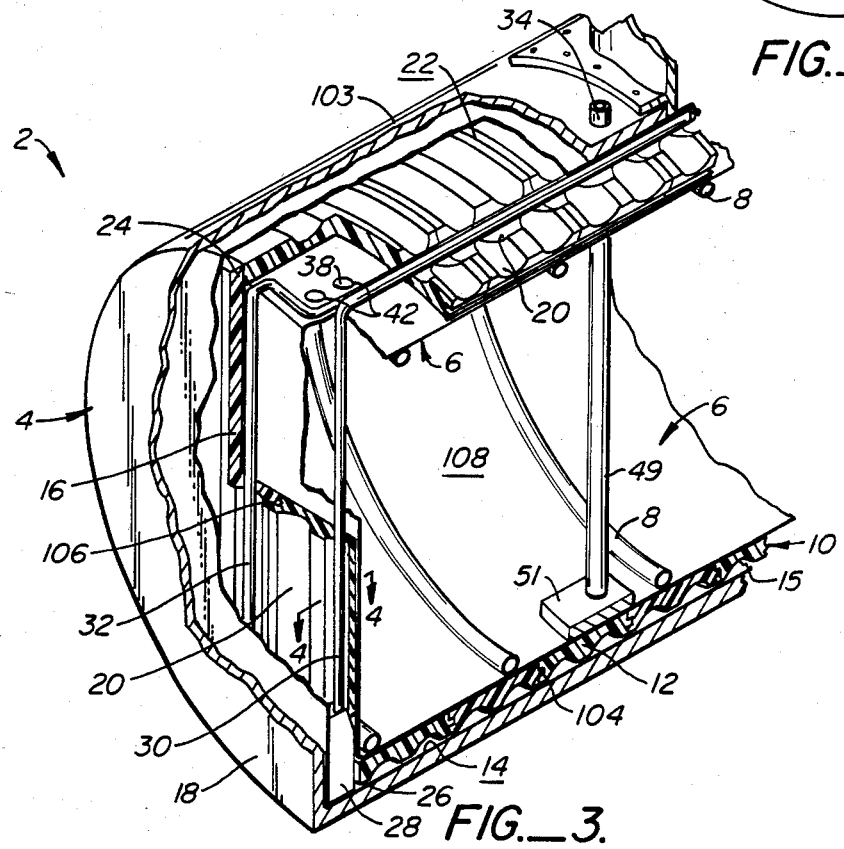
FIG. 3 is an enlarged partial cross-sectional view of the tank of FIG. 1.
Figure 4:
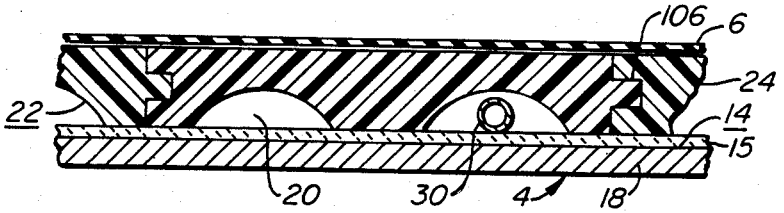
FIG. 4 is an enlarged sectional view taken along line 4—4 of FIG. 3.

Detectors 28 are then installed at low point 26. End separator panels 16 are then mounted to ends 18 of vessel 4 using a suitable adhesive. Arcuate separator panels 12 are then secured to inside surface 14 using an adhesive. Conduit 30 and suction tube 32 are arranged so they pass within grooves 20 in panels 12, 18. Panels 12 are typically sized to cover about one-third of the inner circumference of surface 14 as shown in FIG. 2. Abutting edges 104 and 106 of respective panels 12, 16 interlock in a tongue and groove arrangement for added stability.

Next, inner vessel 6, being in a collapsed, folded state, is passed through manhole assembly 52 and laid out on panels 12 within vessel 4. The position and size of openings 36 and 54 are marked on inner vessel 6 and corresponding openings 38, 70 are cut in inner vessel 6. Rings 40, 42 are then mounted about openings 38 and plug 46 is secured to ring 40. Similarly, lower clamping ring 72 and upper clamp facing sleeve 74 are secured about opening 70 through the use of lower segments 79 of threaded rod 78 and nuts 76.

Inner vessel 6 is then slowly inflated with air through one of the outlet openings 36. Before doing so, manhole opening 70 in inner vessel 6 is temporarily sealed preferably using a flexible flap (not shown) to cover opening 20 from the inside of vessel 6. The use of the flexible flap permits rapid entry into and resealing of inflated vessel 6 so vessel 6 does not deflate prematurely. Proper alignment of outlet openings 36 in vessel 6 with outlet openings 36 in vessel 4 is aided by the use of ropes, not shown, connected to rope rings 48 and passing through pipe connections 34. After inflation, lower segments 79 are secured to upper segments 77 by couplings 80 until inner vessel 6 is captured between edge 82 and ring 72.

Expandable positioning rings 8 are then mounted within interior 108 to maintain the desired, substantially inflated condition of inner vessel 6. Plate 51 is mounted to a ring 8 beneath drop tube 49. After exiting vessels 4 and 6, inner cover 84 is clamped onto ring 72 so that the interior 108 of inner vessel 106 is substantially sealed. System 2 is then tested for the integrity of both sealed rigid outer vessel 4 and flexible inner vessel 6.

Modification and variation can be made to the disclosed embodiment without departing from the subject of the invention as defined in the following claims.

We claim:

1. A storage system with complete secondary containment comprising:

a rigid outer vessel having an outlet opening and having an inside surface defining cavity;

means for sealing said outlet opening;

a flexible cell inner vessel mounted within the cavity and sized to generally conform to the shape of the inside surface;

means of urging the inner vessel toward the inside surface so the inner vessel substantially fills said cavity even when not inflated by fluid pressure;

said inner vessel having an opening formed adjacent said outlet opening; and means for sealing said inner vessel opening separate from the outlet opening sealing means, the outer and inner vessels defining a region therebetween so providing access to said region through said outlet opening sealing means provides no access to the interior of said inner vessel.

2. The system of claim 1 further comprising a spacer layer mounted in the region between the inner and outer vessels over substantially the entire inside surface of the outer vessel, the spacer layer having an outer surface facing the inside surface of the outer vessel and an inner surface.

3. The system of claim 2 wherein said spacer layer includes passageway means formed therein for collecting fluids passing through either said inner or said outer vessel.

4. The system of claim 2 wherein said spacer layer includes a plurality of spacer panels.

5. The system of claim 4 wherein said spacer panels include interlocking edges.

6. The system of claim 3 wherein said passageway means include channels formed in the spacer layer outer surface.

7. The system of claim 2 wherein said urging means includes a plurality of expansion members mounted within said inner vessel arranged and adapted to urge the inner vessel against the spacer layer inner surface.

8. The system of claim 1 wherein said outer vessel includes a plurality of outlet openings and said inner vessel includes corresponding inner vessel openings positioned adjacent said outlet openings.

9. The system of claim 1 further comprising an adapter ring secured to and circumscribing said inner vessel opening.

10. The system of claim 1 wherein said inner vessel sealing means includes an inner cover removably mounted to cover said inner vessel opening;

means for securing said cover to said inner vessel; and means for supportably connecting said cover and said securing means to said outer vessel.

11. The system of claim 1 further comprising a fluid detector, for connection to a monitoring device, for detecting the presence of a fluid in the region between the inner and outer vessels, the fluid detector including a water sensor and a float positioned at a low point in the region to detect the presence of a liquid by the float and to determine if the liquid is water by the water sensor.

12. The system of claim 11 further comprising a tube having an end adjacent and below said float whereby said float can be moved by blowing a fluid through said tube to check for the proper movement of said float.

13. The system of claim 1 wherein said outer vessel has a cylindrical shape.

14. The system of claim 1 wherein said outer opening sealing means includes a manhole assembly having a cylindrical manhole structure having an outer end covered by a removable outer manhole cover, an inner end, means for securing said inner vessel opening to said manhole structure inner end, and wherein the inner vessel sealing means includes an inner manhole cover removably mounted to the inner vessel opening at the manhole structure inner end.

15. The system of claim 14 wherein said inner vessel opening securing means includes a clamping ring mounted to and circumscribing said inner vessel opening and means for biasing said clamping ring against said manhole structure inner end.

16. A storage system with secondary containment comprising:

a rigid outer vessel having a plurality of outlet openings and having an inside surface defining a cavity;

means for sealing the outlet openings;

a flexible cell inner vessel mounted within the cavity and sized to generally conform to the shape of the inside surface of the outer vessel;

a spacer layer, including a plurality of spacer panels, mounted between the inner and outer vessels over substantially the entire outer vessel inside surface and having an outer surface facing the inside surface of the outer vessel and an inner surface, said spacer layer including channels formed in the spacer layer outer surface for collecting fluids passing through either said inner vessel or said outer vessel;

a plurality of expansion members mounted within said inner vessel to urge the inner vessel toward the inside surface so the inner vessel substantially fills said cavity even when not inflated by fluid pressure;

means, mounted in the region between the inner and outer vessels, for detecting the presence of a fluid in said region;

said inner vessel having complementary openings formed adjacent said outlet openings; and means, separate from the outlet openings sealing means, for sealing said inner vessel openings so the inner and outer vessels constitute separately sealable vessels for true secondary containment whereby the inner and outer vessels defining a region therebetween so providing access to said region through said outlet openings sealing means provides no access to the interior of said inner vessel.

17. A method for retrofitting a rigid storage vessel to provide secondary containment, comprising the following steps:

forming a manhole opening in the rigid vessel;

inspecting the rigid vessel;

repairing the rigid vessel as necessary;

placing a flexible cell inner vessel through the manhole opening and into the rigid outer vessel, the inner vessel sized to generally conform to at least a portion of the interior of the rigid vessel when inflated;

inflating the inner vessel;

securing a portion of the inner vessel, which surrounds an opening in the inner vessel, to the rigid vessel with the inner vessel opening and manhole opening being aligned;

mounting a plurality of inner vessel positioning members within the interior region so the inner vessel substantially fills the interior of the rigid vessel;

mounting an inner cover to the inner vessel opening to seal the interior of the inner vessel; and mounting a manhole cover over the manhole opening to seal the interior of the rigid vessel so that true secondary containment is achieved whereby the rigid and inner vessels defining a region therebetween so providing access to said region through said manhole opening providing no access to the interior of said inner vessel.

18. A method for retrofitting a rigid storage vessel to provide secondary containment, comprising the following steps:

ensuring the rigid vessel is empty;

forming a manhole opening in the rigid vessel;

inspecting the rigid vessel;

repairing the rigid vessel as necessary;

covering the rigid vessel inside surface with a coating layer;

installing a fluid detector within the rigid vessel;

mounting spacer members to substantially the entire coating layer;

placing a flexible cell inner vessel through the manhole opening and into the rigid outer vessel, the inner vessel sized to generally conform to at least a portion of the interior of the rigid vessel when inflated;

inflating the inner vessel;

securing a portion of the inner vessel, which surrounds an opening in the inner vessel, to the rigid vessel with the inner vessel opening and manhole opening being aligned;

mounting a plurality of inner vessel positioning members within the interior region so the inner vessel substantially fills the interior of the rigid vessel;

mounting an inner cover to the inner vessel opening to seal the interior of the inner vessel; and mounting a manhole cover over the manhole opening to seal the interior of the rigid vessel so that true secondary containment is achieved whereby the rigid and inner vessels defining a region therebetween so providing access to said region through said manhole opening providing no access to the interior of said inner vessel.

* * * * *

UNITED STATES PATENT AND TRADEMARK OFFICE

CERTIFICATE OF CORRECTION

PATENT NO. : 4,552,166

DATED : November 12, 1985

INVENTOR(S) : DANIEL I. CHADBOURNE, SR. and DANIEL I. CHADBOURNE, JR.

It is certified that error appears in the above-identified patent and that said Letters Patent is hereby corrected as shown below:

Claim 17, line 33, delete "providing" and substitute --provides--.

Claim 18, line 66, delete "providing" and substitute --provides--.

Signed and Sealed this

*Fourth* Day of *March 1986*

[SEAL]

*Attest:*

DONALD J. QUIGG

*Attesting Officer*

*Commissioner of Patents and Trademarks*